US007508184B2

(12) United States Patent
Yen et al.

(10) Patent No.: US 7,508,184 B2
(45) Date of Patent: Mar. 24, 2009

(54) CURRENT SOURCE APPARATUS FOR REDUCING INTERFERENCE WITH NOISE

(75) Inventors: Chih-Jen Yen, Hsinchu (TW); Chih-Yuan Hsieh, Chiayi (TW)

(73) Assignee: Novatek Microelectronics Corp., Hsinchu (TW)

( * ) Notice: Subject to any disclaimer, the term of this patent is extended or adjusted under 35 U.S.C. 154(b) by 208 days.

(21) Appl. No.: 11/465,459

(22) Filed: Aug. 18, 2006

(65) Prior Publication Data

US 2007/0241737 A1 Oct. 18, 2007

(30) Foreign Application Priority Data

Apr. 13, 2006 (TW) ..... 95113136 A

(51) Int. Cl.
*G05F 3/16* (2006.01)
*G05F 3/28* (2006.01)

(52) U.S. Cl. ..... 323/314; 323/316

(58) Field of Classification Search ..... 323/304, 323/311, 312, 313, 314, 315, 316
See application file for complete search history.

(56) References Cited

U.S. PATENT DOCUMENTS 5,012,178 A * 4/1991 Weiss et al. ..... 323/269
5,631,547 A * 5/1997 Fujioka et al. ..... 323/273
5,859,560 A * 1/1999 Matthews ..... 327/513

* cited by examiner

*Primary Examiner*—Gary L Laxton
(74) *Attorney, Agent, or Firm*—Jianq Chyun IP Office

(57) ABSTRACT

A current source apparatus for reducing interference with noise is provided. The current source apparatus includes a controllable current source and a feedback controller. The controllable current source provides an output current according to a control signal and produces a feedback signal according to the output of the controllable current source. The feedback controller is coupled to the controllable current source for receiving the feedback signal, and the feedback controller adjusts the control signal based on the feedback signal and outputs the control signal for controlling the controllable current source to output a stable output current.

16 Claims, 14 Drawing Sheets

CURRENT SOURCE APPARATUS FOR REDUCING INTERFERENCE WITH NOISE

CROSS-REFERENCE TO RELATED APPLICATION

This application claims the priority benefit of Taiwan application serial no. 95113136, filed on Apr. 13, 2006. All disclosure of the Taiwan application is incorporated herein by reference.

BACKGROUND OF THE INVENTION

1. Field of the Invention

The present invention relates to a current source. More particularly, the present invention relates to a current source apparatus for reducing interference with noise.

2. Description of Related Art

Current source is always required in today's electronic products for providing a stable current, for example, a current control oscillator requires a stable current for producing oscillation signals of a specific frequency. An electronic product can operate properly and perform expected functions when the frequency of the oscillation circuit is stable. However, such electronic product cannot be operated properly if the oscillation circuit is not able to provide a stable frequency. Thus, how to provide a stable current source so that the electronic products can operate properly is a very important subject of development.

One of the causes which make a current source unstable is the affection of noises, and is shown in FIG. 1 (the block diagram of a conventional current control oscillator). Referring to FIG. 1, the current source 102 determines the quantity of the current Ib based on the reference voltage Vb. The conventional oscillator 104 determines the frequency of the output oscillation signal Vo thereof based on the quantity of the current Ib. The disadvantage of the conventional oscillator 104 is that the tail current source 102 thereof is working in the saturation region (which is like a common-source amplifier to the noise 106 and a common-gate amplifier to the noise 108). Accordingly, when there is a noise (noise 106 as shown in FIG. 1) occurring at the gate thereof, the noise is amplified, which severely interfere the operation of the oscillator. This current source is equivalent to a common-gate amplifier to the noise produced by the ground GND (denoted as noise 108 in FIG. 1). In other words, when a noise enters the oscillator from the ground terminal, the noise is amplified by the current source working in saturation region, which would also severely interfere the operation of the oscillator. This phenomenon will be described below.

FIG. 2 illustrates a 3-level ring oscillation circuit. Referring to FIG. 2, since the frequency of the oscillator 104 is proportional to the current $I_{DSAT}$ of the tail current source 216, the current $I_{DSAT}$ of the tail current source 216 is changed when a noise (214 or 218) enters the gate or source of the current source, so as to perform frequency modulation to the ring oscillator 104, and the timing response thereof is shown in FIG. 3. Pattern A is the oscillation waveform of an ideal oscillator, and pattern B is the waveform interfered by a noise. It can be understood from pattern B that with noise interference, phase shifts of $\Delta\psi 1$, $\Delta\psi 2$, $\Delta\psi 3$, and $\Delta\psi 4$ occur to the frequency of the oscillator, thus the frequency of the oscillator changes along with the change of time, which may cause phase error (i.e. jitter). Thus, in the conventional circuit, the noise entering from the gate and/or source of the current source may be amplified and which may cause jitters, and the current source in the conventional circuit is very sensitive to the interference of the voltage source VDD, the power supply rejection ratio (PSRR, which shows the capability of preventing noise coupling from power supply) is not ideal. Moreover, the output impedance of the current source in the conventional circuit is low, so that the noise from the ring oscillator itself increases jitter through modulating the current of the current source.

SUMMARY OF THE INVENTION

Accordingly, the present invention is directed to a current source apparatus for reducing interference with noise, which allows the circuit employing the current source apparatus in the present invention to perform properly with the stable current source thereof without noise interference, and improves the stability of the circuit. In particular, when the circuit is an oscillator circuit, jitter caused by noise carried in from the current source can be further improved. Meanwhile, in the present invention, the problem of the conventional current source being over-sensitive to the interference of the voltage source thereof can be avoided, and the power supply rejection ratio (PSRR) in the present invention is better than that of the conventional current source.

In accordance with the aforementioned objectives and other objectives of the present invention, a current source apparatus for reducing interference with noise is provided. The current source apparatus includes a controllable current source and a feedback controller. The controllable current source provides an output current based on a control signal and produces a feedback signal based on the output of the controllable current source. The feedback controller is coupled to the controllable current source and is used for receiving the feedback signal. The feedback controller adjusts and outputs the control signal based on the feedback signal, so as to control the controllable current source to output a stable output current.

In the current source apparatus for reducing interference with noise according to exemplary embodiments of the present invention, the controllable current source includes a master current source and a slave current source. The master current source receives a control signal, adjusts and produces a master current based on the control signal, and outputs a feedback signal based on the produced master current. The slave current source is coupled to the master current source and is used for producing a corresponding output current based on the master current.

As described above, in the present invention, a current source with negative feedback mechanism is adopted for stabilizing the output current of the current source under interference.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

In order to prevent jitter caused by the amplified noise carried in from the gate and/or source of the current source in a conventional circuit, and to reduce the sensitivity of the current source to voltage source VDD and increase the performance in preventing noise coupling from power supply, the present invention provides a current source apparatus, which will be described below in accordance with the following embodiments.

Figure 1:
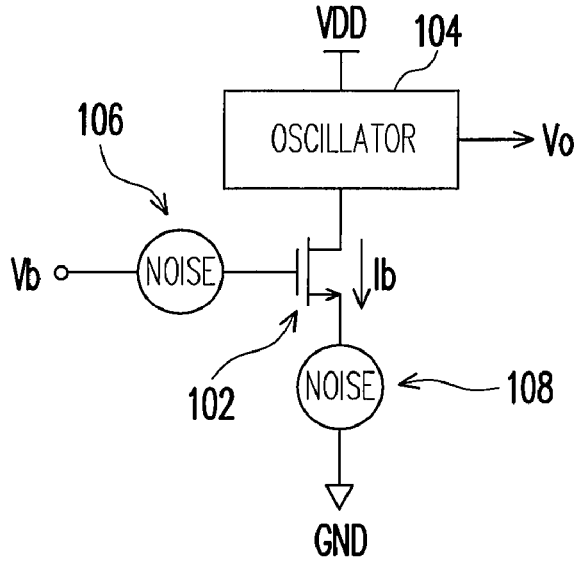
FIG. 1 (PRIOR ART)
FIG. 1 is a schematic block diagram of a conventional current control oscillator.
Figure 2:
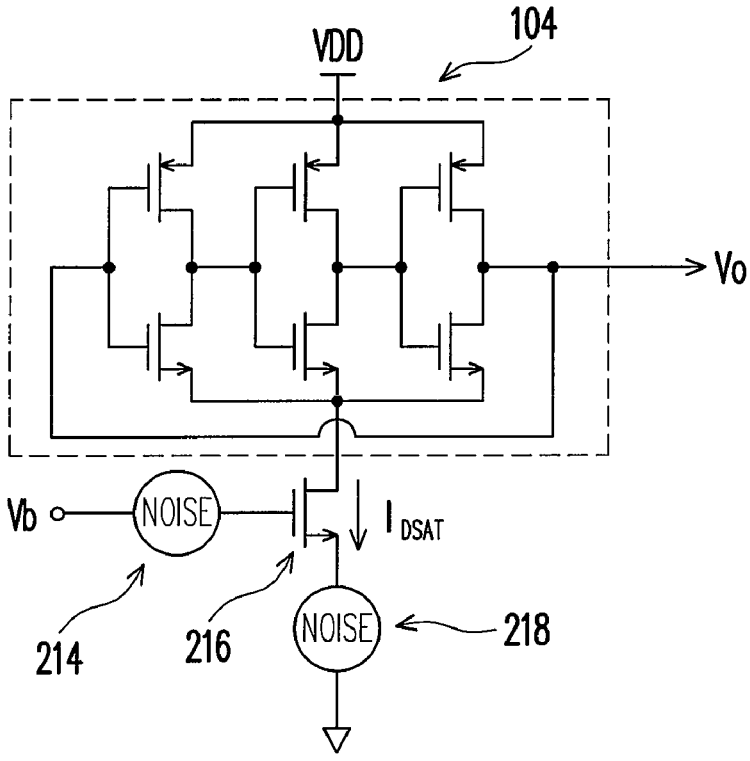
FIG. 2 (PRIOR ART)
FIG. 2 is a circuit diagram of a conventional current source and a simple ring oscillator.
Figure 3:
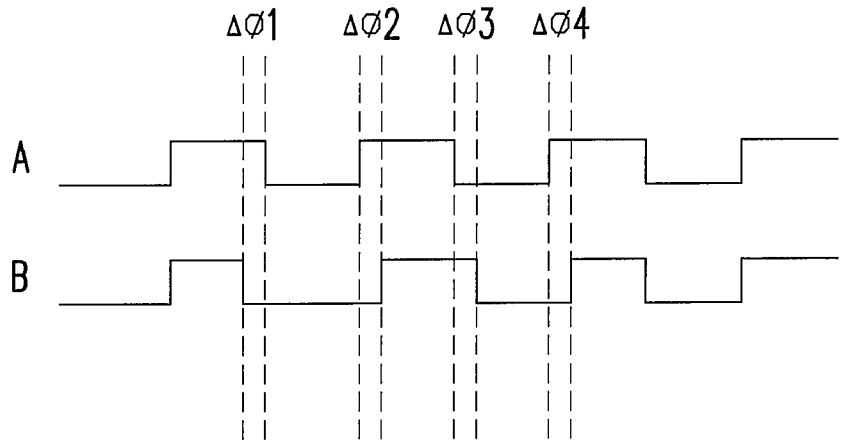
FIG. 3 (PRIOR ART)
FIG. 3 is a comparative diagram of the output of a ring oscillator interfered by the noise of a conventional current source and the ideal output.
Figure 4:
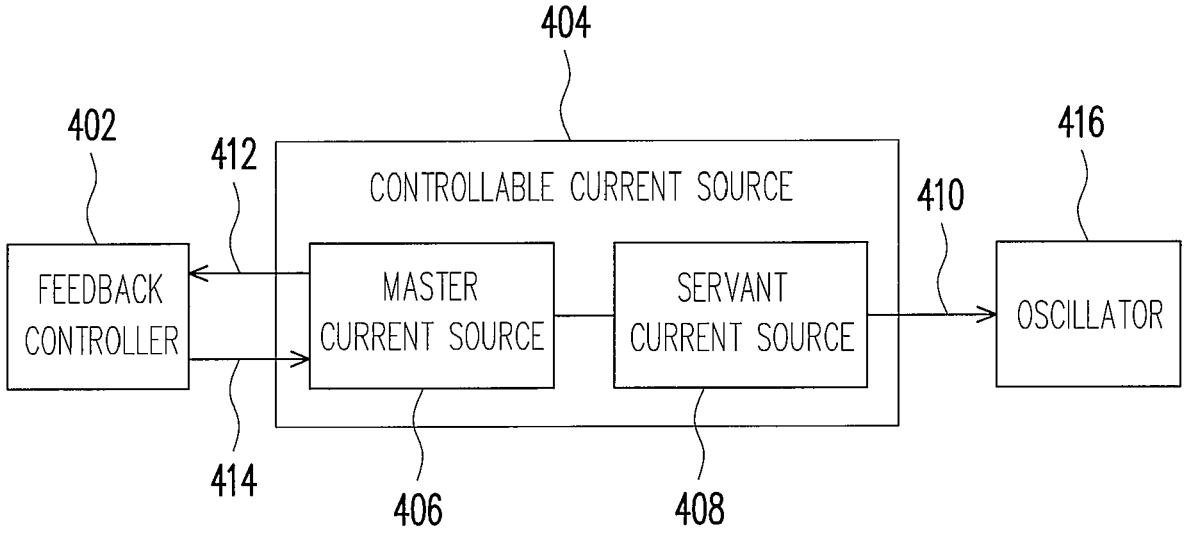
FIG. 4 is a schematic block diagram illustrating the circuit of a current source apparatus for reducing interference with noise.

FIG. 4 is a schematic block diagram illustrating the circuit of a current source apparatus for reducing interference with noise according to an embodiment of the present invention. Referring to FIG. 4, the current source includes a controllable current source 404 and a feedback controller 402, and the controllable current source 404 further includes a master current source 406 and a slave current source 408. The controllable current source 404 correspondingly produces an output current 410 based on a control signal 414 provided by the feedback controller 402, and produces a feedback signal 412 from the master current source 406 of the controllable current source 404. The feedback controller 402 is coupled to the controllable current source 404 for receiving the feedback signal 412 and adjusting and outputting the control signal 414 based on the feedback signal 412, so that the controllable current source 404 can be controlled to output the stable output current 410. A few examples will be used to describe various implementations of the current source in FIG. 4.

Figure 5:
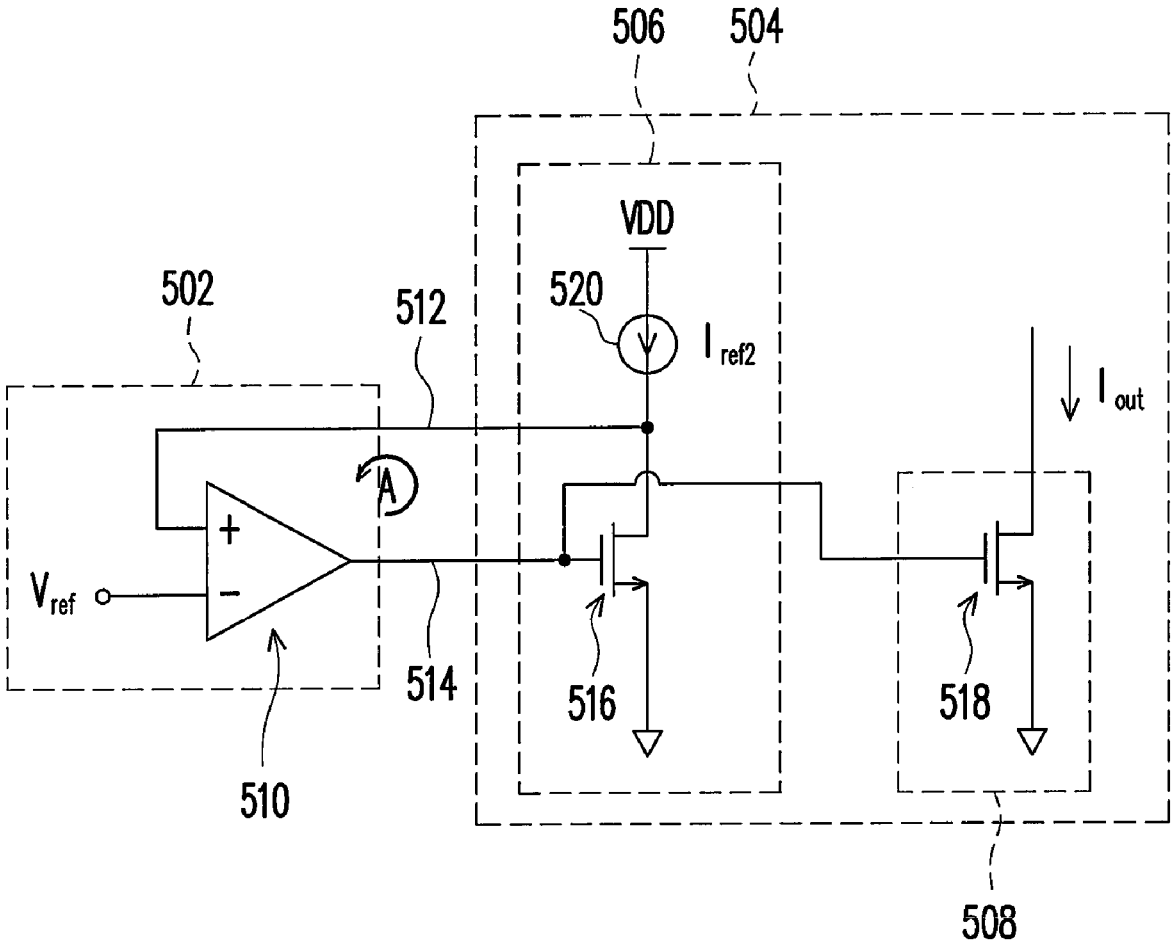
FIGS. 5~12 are respectively circuit diagrams of a current source apparatus for reducing interference with noise according to various embodiments of the present invention.

FIG. 5 is a circuit diagram of a current source apparatus for reducing interference with noise according to an embodiment of the present invention. Referring to FIG. 5, the feedback controller 502 represents the feedback controller 402 in FIG. 4, the controllable current source 504 represents the controllable current source 404 in FIG. 4, the master current source 506 represents the master current source 406 in FIG. 4, and the slave current source 508 represents the slave current source 408 in FIG. 4.

In the present embodiment, the feedback controller 502 includes an operational amplifier 510, the master current source 506 includes a second transistor 516 (N-type transistor in the drawings) and a reference current source 520 which provides a second reference current $I_{ref2}$, and the slave current source 508 includes a third transistor 518 (N-type transistor in the drawings). In the present embodiment, all the transistors have first terminals and second terminals, wherein the first terminals are drains, and the second terminals are sources. The first input terminal of the operational amplifier 510 (here it is the positive input terminal) is coupled to the drain of the transistor 516 and the reference current source 520, and the second input terminal thereof (negative input terminal in the drawings) is coupled to the reference voltage $V_{ref}$. The output terminal of the operational amplifier 510 is coupled to the gate of the transistors 516 and 518. The drain of the transistor 516 is coupled to the reference current source 520, the source thereof is coupled to the second constant voltage (ground voltage in the drawings). The source of the transistor 518 is coupled to the ground voltage, and the drain current thereof is the output current $I_{out}$. While in the master current source 506, a feedback signal 512 is provided from the drain of the transistor 516 to the positive input terminal of the operational amplifier 510. The positive input terminal compares the feedback signal 512 and the reference voltage $V_{ref}$ of the negative input terminal, then outputs a control signal 514, and controls the gate voltage of the slave current source 518 through the control signal 514 so as to output a stable output current $I_{out}$.

FIG. 4 is a schematic block diagram illustrating the circuit of a current source apparatus for reducing interference with noise according to an embodiment of the present invention. Referring to FIG. 4, the current source includes a controllable current source 404 and a feedback controller 402, and the controllable current source 404 further includes a master current source 406 and a slave current source 408. The controllable current source 404 correspondingly produces an output current 410 based on a control signal 414 provided by the feedback controller 402, and produces a feedback signal 412 from the master current source 406 of the controllable current source 404. The feedback controller 402 is coupled to the controllable current source 404 for receiving the feedback signal 412 and adjusting and outputting the control signal 414 based on the feedback signal 412, 50 that the controllable current source 404 can be controlled to output the stable output current 410. The stable output current 410 is used for driving an oscillator 416, and the oscillator 416 is a current control oscillator. A few examples will be used to describe various implementations of the current source in FIG. 4.

In the present embodiment, the feedback controller 602 includes an operational amplifier 610, the master current source 606 includes a second transistor 616 (P-type transistor in the drawings) and a reference current source 620 which provides a second reference current $I_{ref2}$, and the slave current source 608 includes a third transistor 618 (P-type transistor in the drawings). In the present embodiment, all the transistors have first terminals and second terminals, and the first terminals are drains and the second terminals are sources.

The first input terminal of the operational amplifier 610 (positive input terminal in the drawings) is coupled to the drain of the transistor 616 and the reference current source 620, and the second input terminal thereof (negative input terminal in the drawings) is coupled to the reference voltage $V_{ref}$. The output terminal of the operational amplifier 610 is coupled to the gates of the transistors 616 and 618. The source of the transistor 616 is coupled to the second constant voltage (supply voltage VDD in the drawings). The source of the transistor 618 is coupled to the supply voltage VDD, and the drain current thereof is the output current $I_{out}$. In the master current source, a feedback signal 612 is provided from the drain of the transistor 616 to the positive input terminal of the operational amplifier 610. The operational amplifier 610 compares the feedback signal 612 of the positive input terminal and the reference voltage $V_{ref}$ of the negative input terminal, outputs a control signal 614, and controls the gate voltage of the slave current source 618 through the control signal 614 so as to output a stable output current $I_{out}$.

Figure 6:
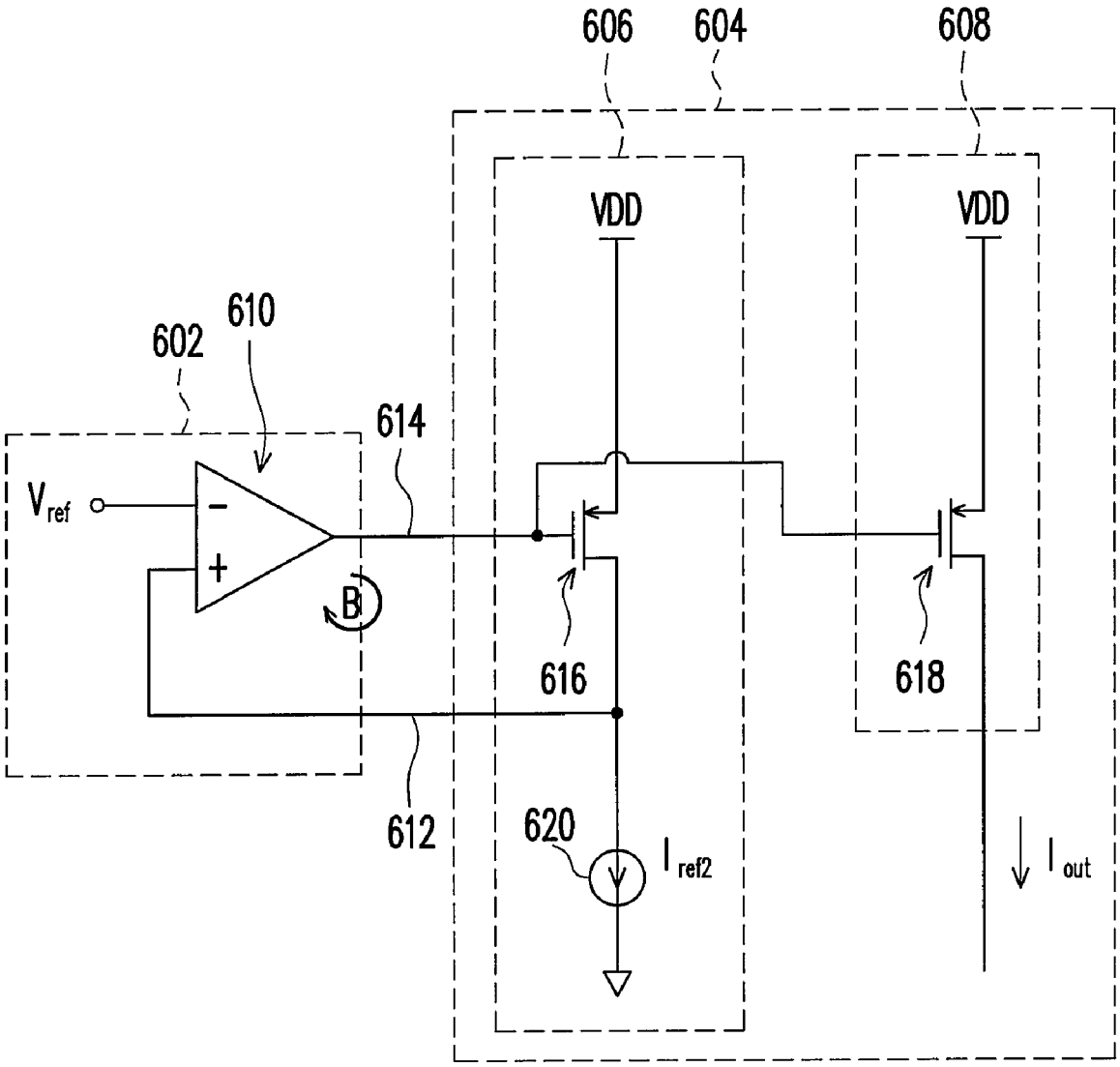
Figure 7:
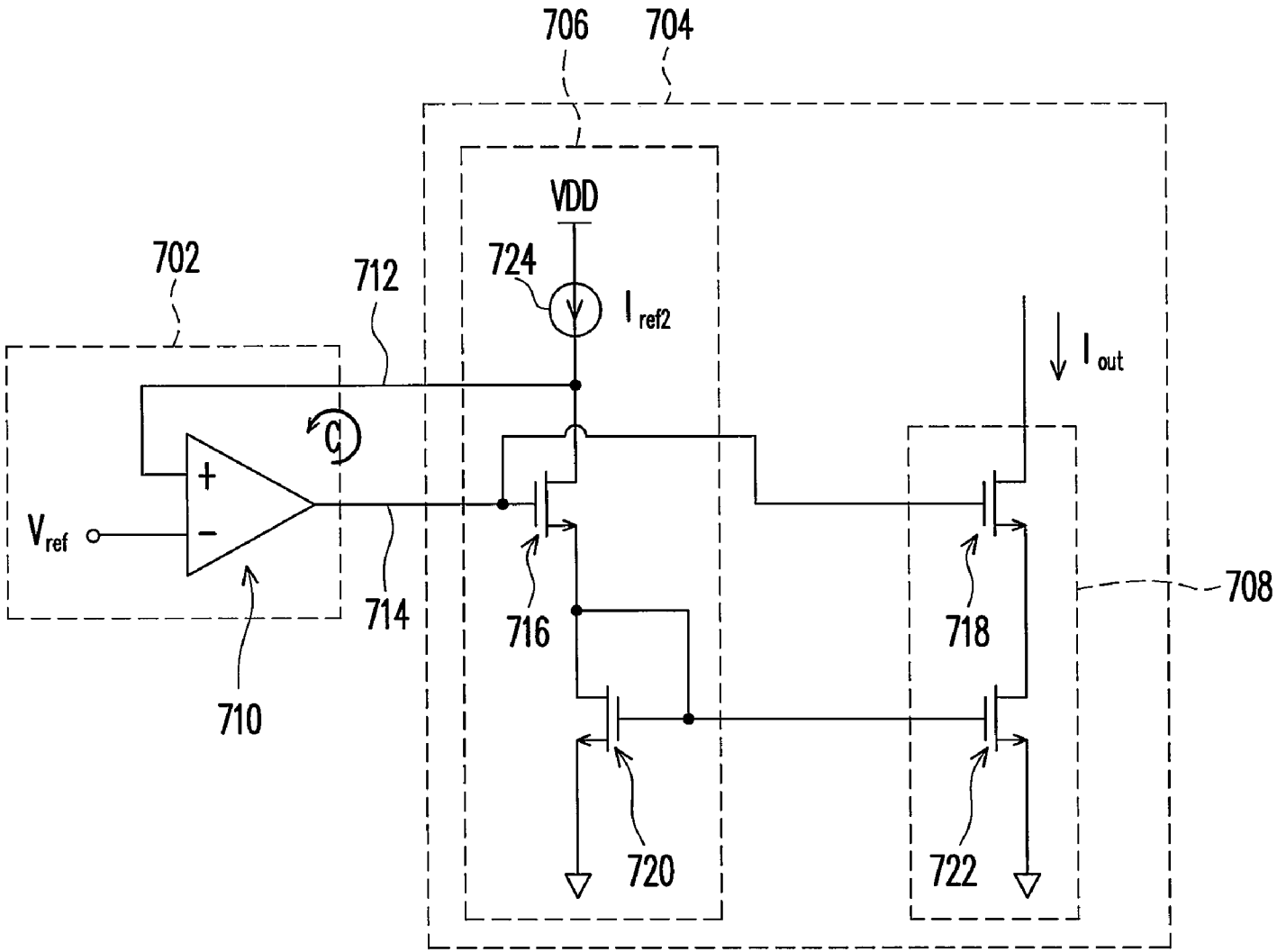
Figure 8:
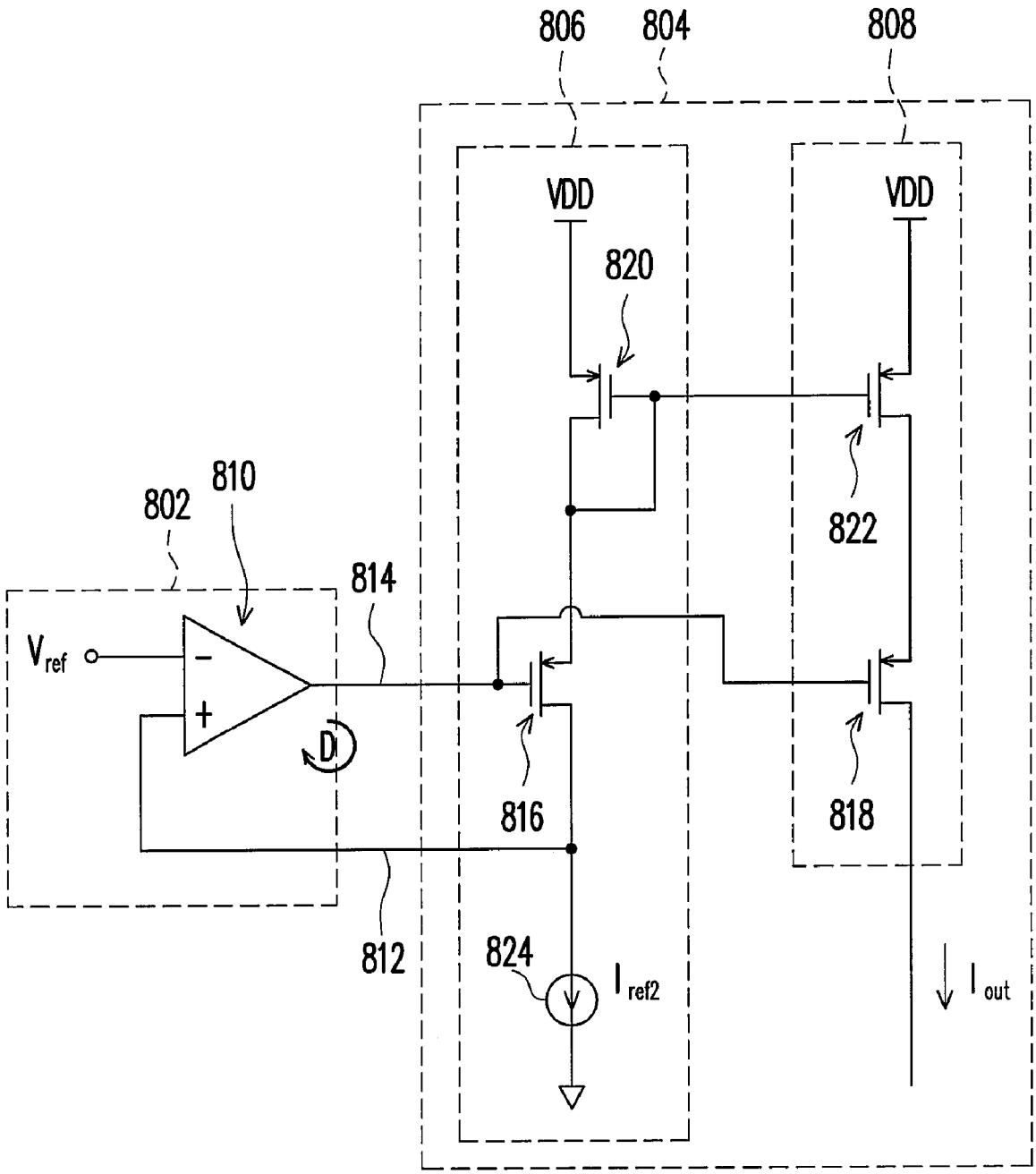

The embodiments in FIG. 5 and FIG. 6 can be revised according to requirement by those skilled in the art. For example, a current mirror can be disposed on the current paths of the master current source and the slave current source (as shown in FIG. 7 and FIG. 8) so as to increase the output impedance. FIG. 7 is a circuit diagram of a current source apparatus for reducing interference with noise according to another embodiment of the present invention. Referring to FIG. 7, the feedback controller 702 represents the feedback controller 402 in FIG. 4, the controllable current source 704 represents the controllable current source 404 in FIG. 4, the master current source 706 represents the master current source 406 in FIG. 4, and the slave current source 708 represents the slave current source 408 in FIG. 4. Here, the operational amplifier 710, the second reference current source 724, the second transistor 716, and the third transistor 718 are respectively similar to the operational amplifier 510, the second reference current source 520, the second transistor 516, and the third transistor 518 in FIG. 5, therefore the description thereof will not be repeated. The fourth transistor 720 and the fifth transistor 722 (both N-type transistors form a current mirror in the drawings). The gate and the drain of the transistor 720 are coupled to the source of the transistor 716 and the gate of the transistor 722. The sources of the transistors 720 and 722 are coupled to the second constant voltage (ground voltage in the drawings). The drain of the transistor 722 is coupled to the source of the transistor 718. Thus, in the master current source, a feedback signal 712 is provided from the drain of the transistor 716 to the positive input terminal of the operational amplifier 710. The operational amplifier 710 compares the feedback signal 712 of the positive input terminal and the reference voltage $V_{ref}$ of the negative input terminal, then outputs a control signal 714, and controls the gate voltage of the slave current source 718 through the control signal 714 so as to output a stable output current $I_{out}$.

FIG. 8 is a circuit diagram of a current source apparatus for reducing interference with noise according to another embodiment of the present invention. Referring to FIG. 8, the feedback controller 802 represents the feedback controller 402 in FIG. 4, the controllable current source 804 represents the controllable current source 404 in FIG. 4, the master current source 806 represents the master current source 406 in FIG. 4, and the slave current source 808 represents the slave current source 408 in FIG. 4. Here, the operational amplifier 810, the second reference current source 824, the second transistor 816, and the third transistor 818 are respectively similar to the operational amplifier 610, the second reference current source 620, the second transistor 616, and the third transistor 618, therefore will not be described herein. The fourth transistor 820 and the fifth transistor 822 (both P-type transistors in the drawings) form a current mirror. The gate and drain of the transistor 820 are coupled to the source of the transistor 816 and the gate of the transistor 822. Here, the sources of the transistors 820 and 822 are both coupled to the second constant voltage (supply voltage VDD in the drawings). The drain of the transistor 822 is coupled to the source of the transistor 818. In the master current source 806, a feedback signal 812 is provided from the drain of the transistor 816 to the positive input terminal of the operational amplifier 810. The operational amplifier 810 compares the feedback signal 812 of the positive input terminal and the reference voltage $V_{ref}$ of the negative input terminal, then outputs a control signal 814, and controls the gate voltage of the slave current source 818 through the control signal 814 so as to output a stable output current $I_{out}$.

Figure 9:
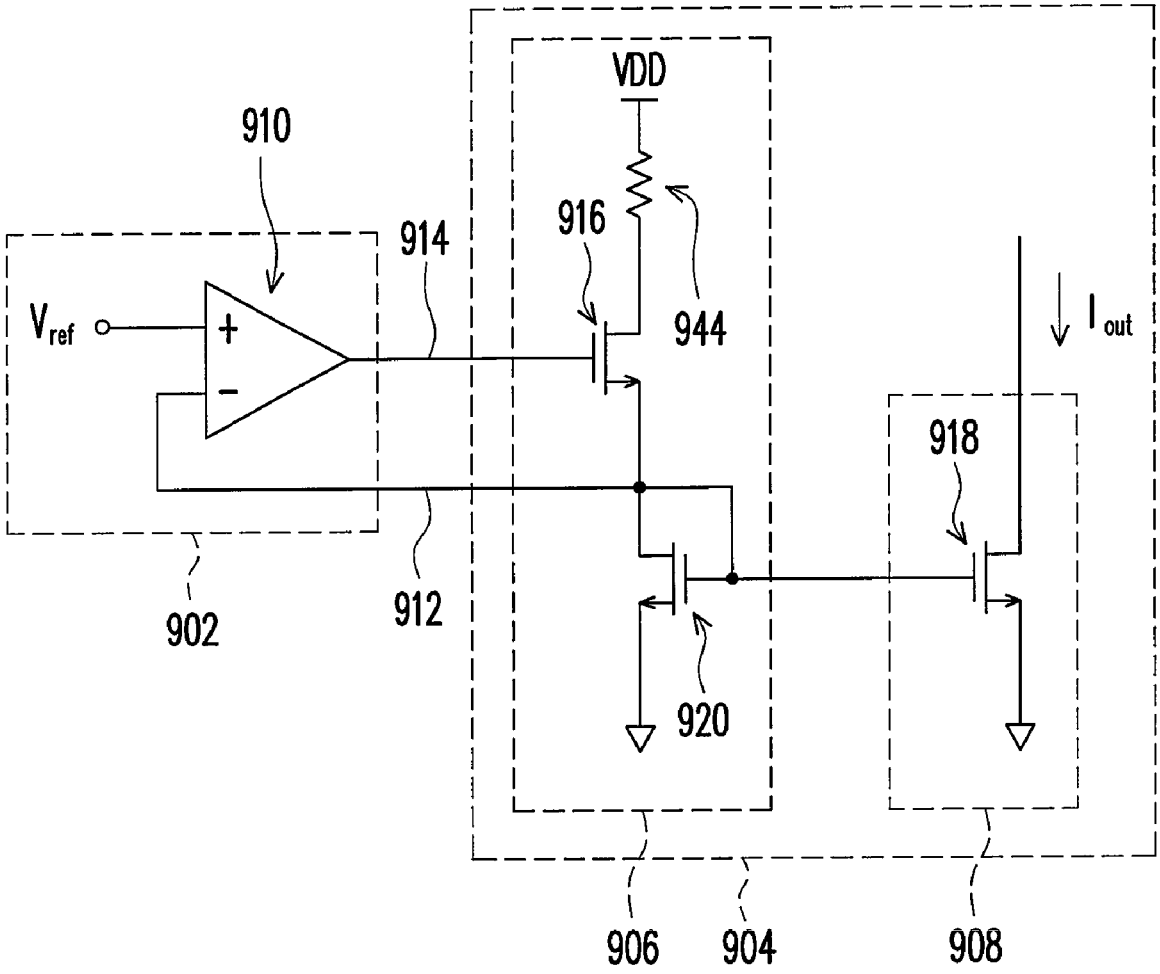

FIG. 9 is a circuit diagram of a current source apparatus for reducing interference with noise according to another embodiment of the present invention. Referring to FIG. 9, the feedback controller 902 represents the feedback controller 402 in FIG. 4, the controllable current source 904 represents the controllable current source 404 in FIG. 4, the master current source 906 represents the master current source 406 in FIG. 4, and the slave current source 908 represents the slave current source 408 in FIG. 4. The feedback controller 902 includes an operational amplifier 910. In the controllable current source 904, the master current source 906 includes a second transistor 916, a fourth transistor 920, and an impedance 944, and the slave current source 908 includes a third transistor 918. In the present embodiment, all the transistors are N-type transistors, and all the transistors have first terminals and second terminals, wherein the first terminals are drains and the second terminals are sources. The first input terminal of the operational amplifier 910 (negative input terminal in the drawings) is coupled to the source of the transistor 916 and the drain and gate of the transistor 920, and the second input terminal thereof (positive input terminal in the drawings) is coupled to the reference voltage $V_{ref}$. The output terminal of the operational amplifier 910 is coupled to the gate of the transistor 916. Both terminals of the impedance 944 are respectively coupled to the supply voltage VDD and the drain of the transistor 916. In the present embodiment, the sources of the transistors 918 and 920 are both coupled to the second constant voltage (ground voltage in the drawings). The gate of the transistor 918 is coupled to the gate of the transistor 920, and the drain current thereof is the output current $I_{out}$. In the master current source, a feedback signal 912 is provided from the source of the transistor 916 to the negative input terminal of the operational amplifier 910. The operational amplifier 910 compares the feedback signal 912 of the negative input terminal and the reference voltage $V_{ref}$ of the positive input terminal, then output a control signal 914 for controlling the current of the master current source 906. The slave current source 908 correspondingly produces a stable output current $I_{out}$ based on the current of the master current source 906.

Figure 10:
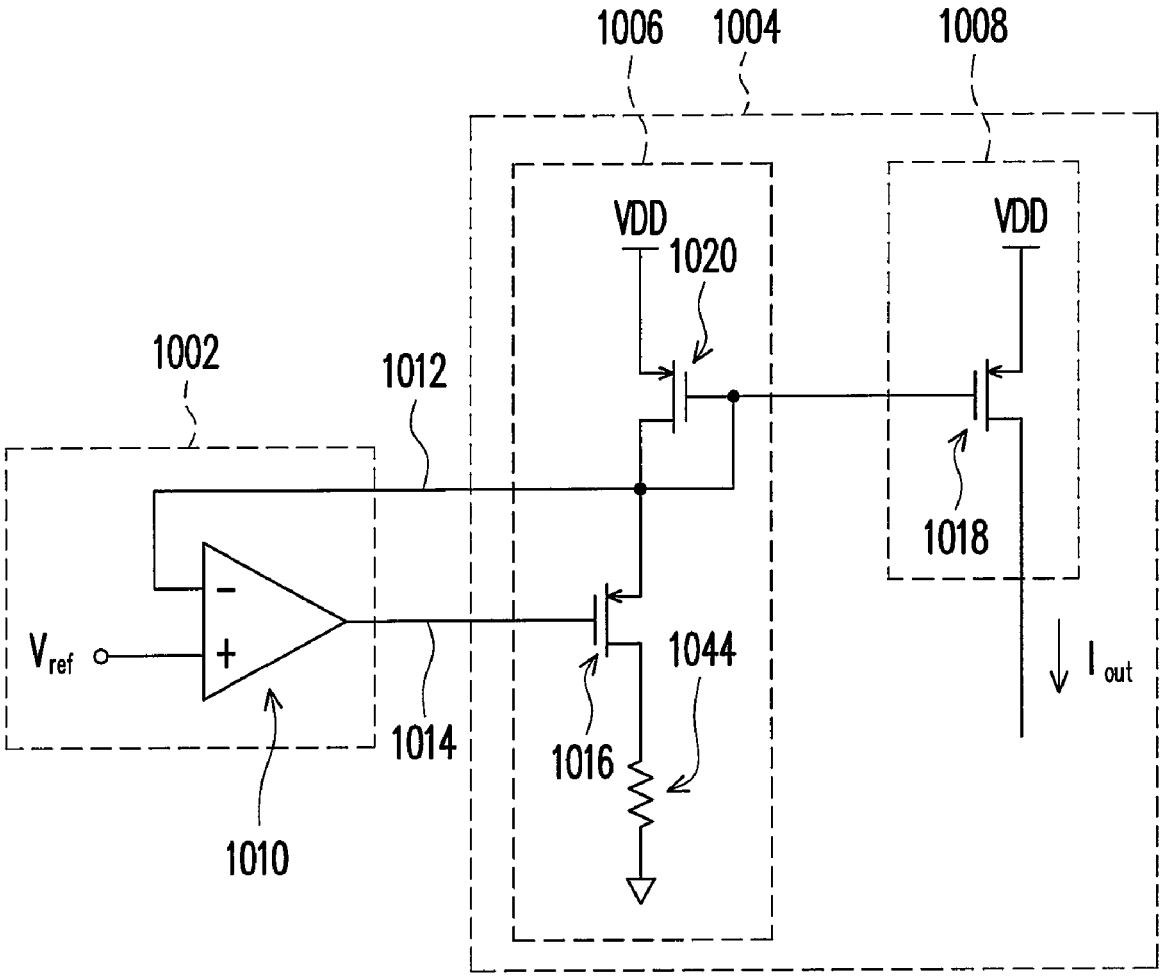

FIG. 10 is a circuit diagram of a current source apparatus for reducing interference with noise according to another embodiment of the present invention. Referring to FIG. 10, the feedback controller 1002 represents the feedback controller 402 in FIG. 4, the controllable current source 1004 represents the controllable current source 404 in FIG. 4, the master current source 1006 represents the master current source 406 in FIG. 4, and the slave current source 1008 represents the slave current source 408 in FIG. 4. The feedback controller 1002 includes an operational amplifier 1010. In the controllable current source 1004, the master current source 1006 includes a second transistor 1016, a fourth transistor 1020, and an impedance 1044, and the slave current source 1008 includes a third transistor 1018. In the present embodiment, all the transistors are P-type transistors, and all the transistors have first terminals and second terminals, wherein the first terminals are drains and the second terminals are sources.

The first input terminal of the operational amplifier 1010 (negative input terminal in the drawings) is coupled to the source of the transistor 1016, the drain and gate of the transistor 1020, and the gate of the transistor 1018. The second input terminal of the operational amplifier 1010 (positive input terminal in the drawings) is coupled to the reference voltage $V_{ref}$, and the output terminal thereof is coupled to the gate of the transistor 1016. The two terminals of the impedance 1044 are respectively coupled to the ground voltage and the drain of the transistor 1016. In the present embodiment, the sources of the transistors 1018 and 1020 are both coupled to the second constant voltage (supply voltage VDD in the drawings). The drain current of the transistor 1018 is output current $I_{out}$.

Thus, in the master current source 1006, a feedback signal 1012 is provided from the source of the transistor 1016 to the negative input terminal of the operational amplifier 1010. The operational amplifier 1010 compares the feedback signal 1012 of the negative input terminal and the reference voltage $V_{ref}$ of the positive input terminal, then output the control signal 1014 for controlling the current of the master current source 1006. The slave current source 1008 correspondingly produces a stable output current $I_{out}$ based on the current of the master current source 1006.

Figure 11:
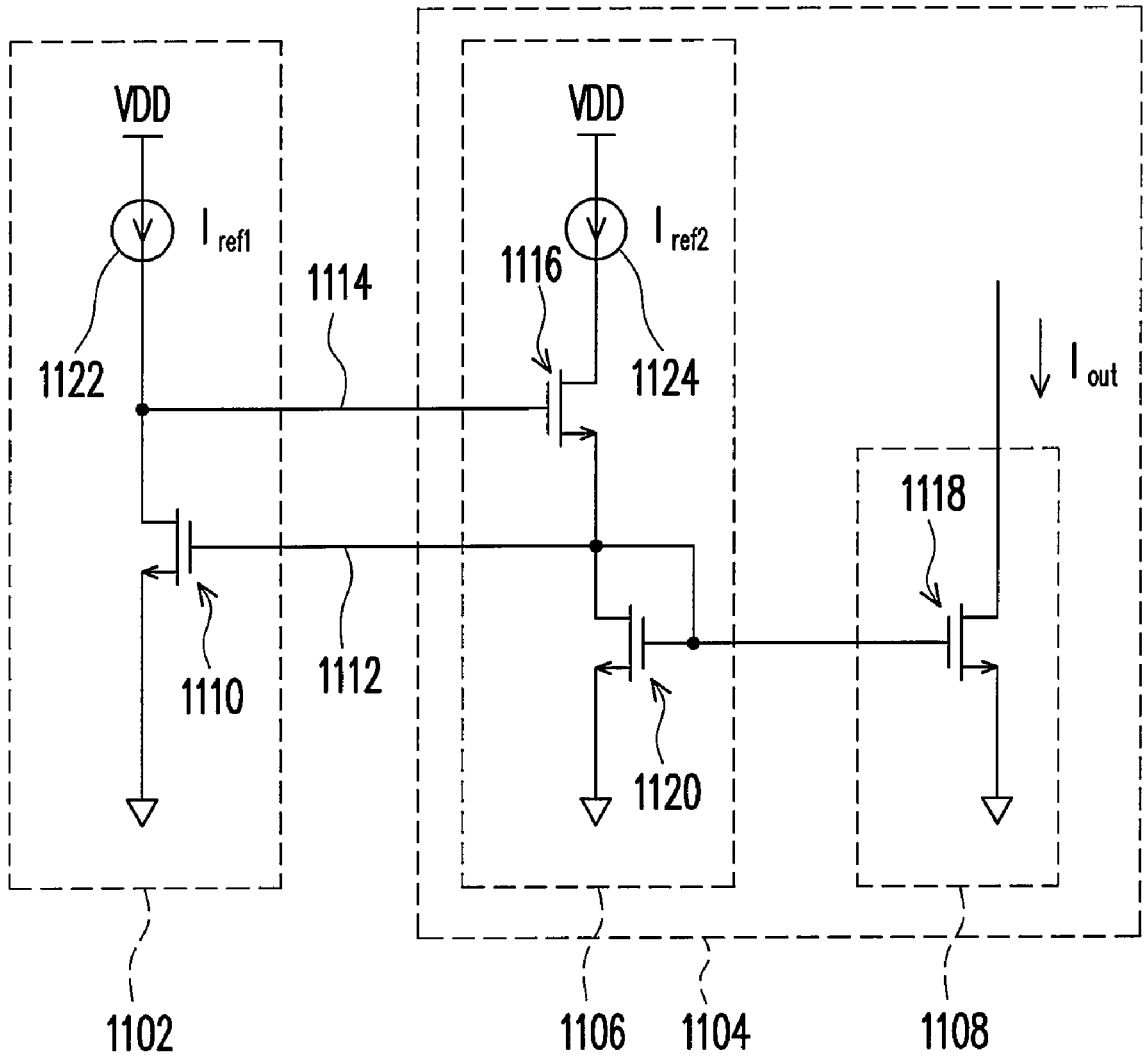

FIG. 11 is a circuit diagram of a current source apparatus for reducing interference with noise according to another embodiment of the present invention. Referring to FIG. 11, the feedback controller 1102 represents the feedback controller 402 in FIG. 4, the controllable current source 1104 represents the controllable current source 404 in FIG. 4, the master current source 1106 represents the master current source 406 in FIG. 4, and the slave current source 1108 represents the slave current source 408 in FIG. 4.

The feedback controller 1102 includes a first transistor 1110 and a first reference current source 1122 which provides a first reference current $I_{ref1}$. The master current source 1106 includes a second transistor 1116, the fourth transistor 1120, and a second reference current source 1124 which provides a second reference current $I_{ref2}$. The slave current source 1108 includes a third transistor 1118. In the present embodiment, all the transistors are N-type transistors, and all the transistors have first terminals and second terminals, wherein the first terminals are drains and the second terminals are sources.

The gate of the transistor 1110 is coupled to the drain and gate of the transistor 1120, the source of the transistor 1116, and the gate of the transistor 1118. The drain of the transistor 1110 is coupled to the first reference current source 1122 and the gate of the transistor 1116. The source of the transistor 1110 is coupled to the first constant voltage (ground voltage in the drawings).

The drain of the transistor 1116 is coupled to the second reference current source 1124. The sources of the transistors 1118 and 1120 are coupled to the second constant voltage (ground voltage in the drawings). The drain current of the transistor 1118 is output current $I_{out}$. In the master current source, a feedback signal 1112 is provided from the source of the transistor 1116 to the gate of the transistor 1110, and the drain of the transistor 1110 outputs a control signal 1114 for controlling the current of the master current source 1106. The slave current source 1108 correspondingly produces a stable output current $I_{out}$ based on the current of the master current source 1108.

Figure 12:
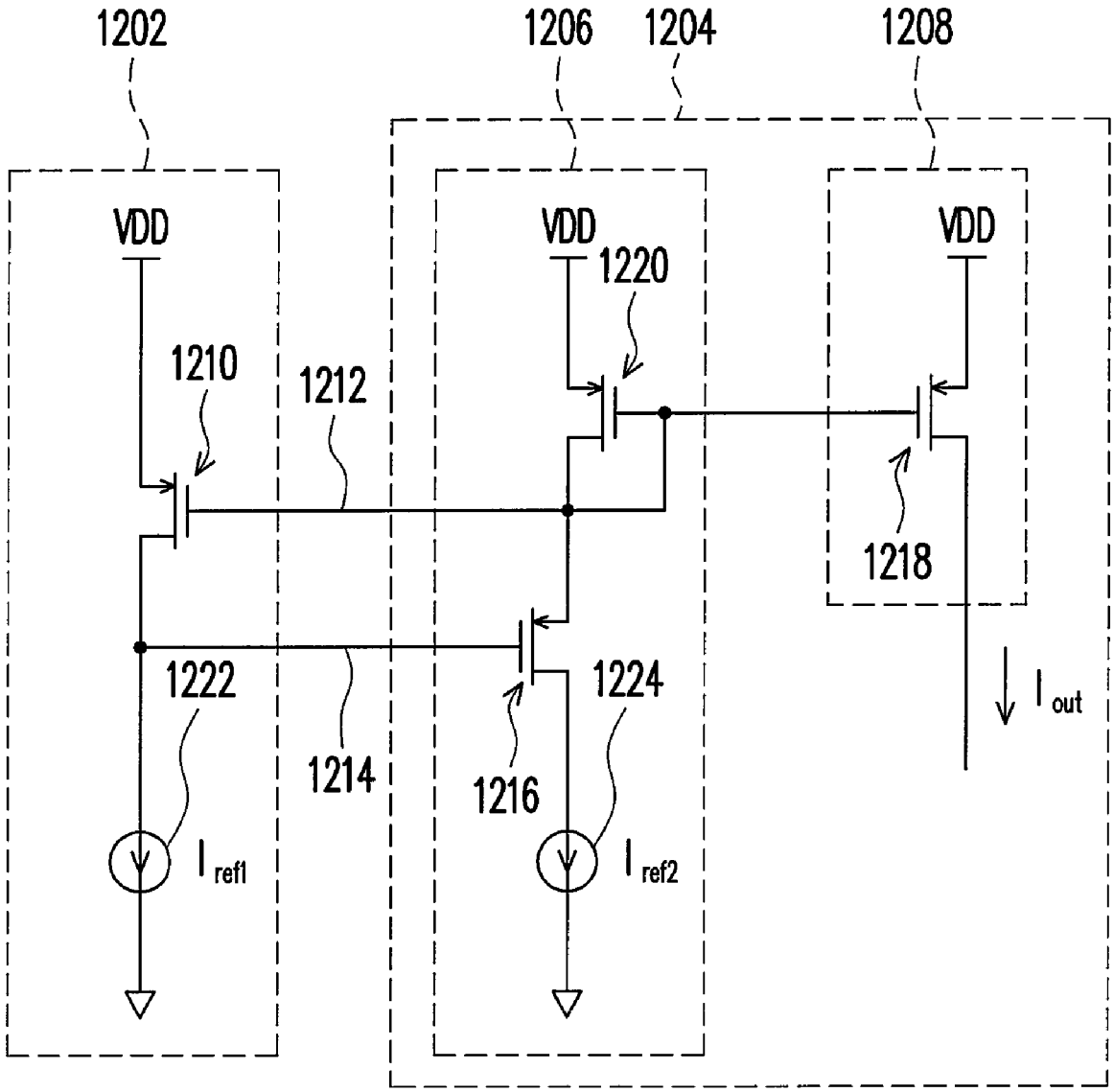

FIG. 12 is a circuit diagram of a current source apparatus for reducing interference with noise according to another embodiment of the present invention. Referring to FIG. 12, the feedback controller 1202 represents the feedback controller 402 in FIG. 4, the controllable current source 1204 represents the controllable current source 404, the master current source 1206 represents the master current source 406 in FIG. 4, and the slave current source 1208 represents the slave current source 408 in FIG. 4. The feedback controller 1202 includes a first transistor 1210 and a first reference current source 1222 which provides a first reference current $I_{ref1}$. The master current source 1206 includes a second transistor 1216, a fourth transistor 1220, and a second reference current source 1224 which provides a second reference current $I_{ref2}$. The slave current source 1208 includes a third transistor 1218. In the present embodiment, all the transistors are P-type transistors, and all the transistors have first terminals and second terminals, wherein the first terminals are drains and the second terminals are sources.

The gate of the transistor 1210 is coupled to the drain and gate of the transistor 1220 and the source of the transistor 1216, the drain of the transistor 1210 is coupled to the first reference current source 1222 and the gate of the transistor 1216, and the source of the transistor 1210 is coupled to the first constant voltage (supply voltage VDD in the drawings). The drain of the transistor 1216 is coupled to the second reference current source 1224. The sources of the transistors 1220 and 1218 are both coupled to the second constant voltage (supply voltage VDD in the drawings). The gate of the transistor 1218 is coupled to the gate of the transistor 1220, and the drain current of the transistor 1218 is the output current $I_{out}$. In the master current source, a feedback signal 1212 is provided from the source of the transistor 1216 to the gate of the transistor 1210, and the drain of the transistor 1210 outputs the control signal 1214 for controlling the current of the master current source 1206. The slave current source 1208 correspondingly produces a stable output current $I_{out}$ based on the current of the master current source 1206.

In addition, the feedback signals in the embodiments described above are all within the scope of the present invention regardless whether they are voltage signals or current signals. Moreover, all the output currents in the embodiments described above can be employed for driving the oscillator, for example, for driving a current control oscillator.

In the present invention, a tail current source with feedback mechanism (for example negative feedback mechanism) is adopted for preventing the noise source to be amplified and reducing the interference of the noise to the oscillator frequency. Negative feedback means that a negative feedback loop is disposed on the bias path of the current source. The dissipation of the loop is illustrated as loop A in FIG. 5, loop B in FIG. 6, loop C in FIG. 7, and loop D in FIG. 8 etc. Accordingly, the suppression effect of the negative feedback circuit can be used for attenuate noise. In other words, when there is noise introduced, the negative feedback circuit performs its clapping effect so that the current of the current source remain unaffected by the noise. Furthermore, the current source is disposed between the voltage source VDD and the oscillator for isolating the noise from VDD.

Figure 13:
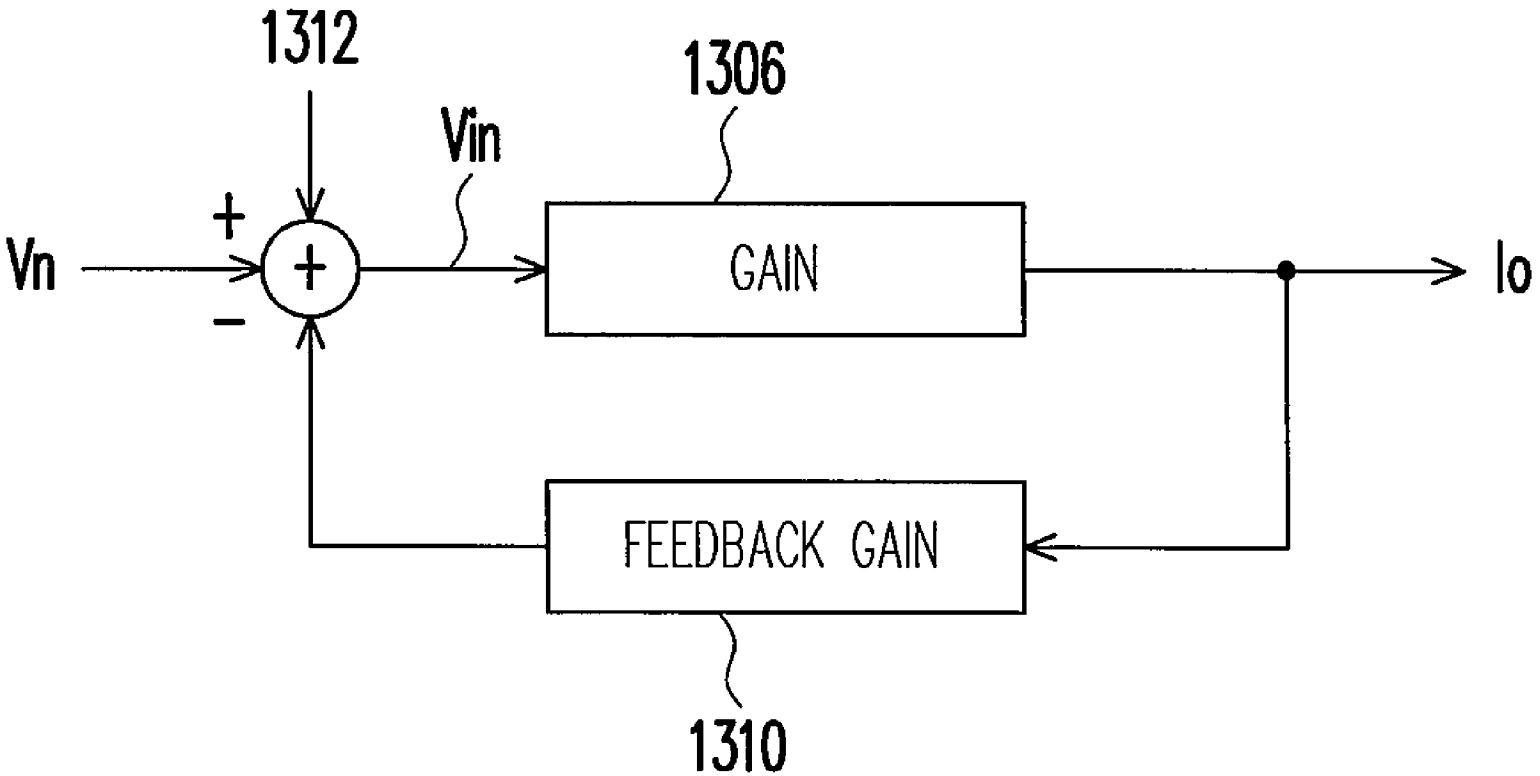
FIG. 13 is a schematic diagram of a circuit with negative feedback according to an embodiment of the present invention.

The negative feedback mechanism can be described with reference to FIG. 13. There are 6 symbols in FIG. 13, wherein Vn denotes the noise, Vin denotes the input voltage, and Io denotes the output current. Block 1306 represents the gain gm between the output current Io and the input voltage Vin, so that the output thereof is Vin·Gm. Block 1310 represents the feedback gain β, so that the output thereof is Io·β. Circle 1312 represents signal addition. The following formula can be derived from FIG. 13:

$$Vin = Vn - Io \cdot \beta \tag{1}$$

$$Io = gm \cdot Vin \tag{2}$$

The relationship between the output current Io and the noise Vn can be deduced from the foregoing formulae (1) and (2) as $$\frac{gm}{1 + gm \cdot \beta}.$$

However, if the circuit block does not have negative feedback, the relationship between the output current Io and the noise Vn is gm, that is, the denominator of the original relationship with negative feedback mechanism is skipped, thus, the anti-noise performance of the circuit with negative feedback mechanism is much better than that of the circuit without negative feedback mechanism.

Figure 14:
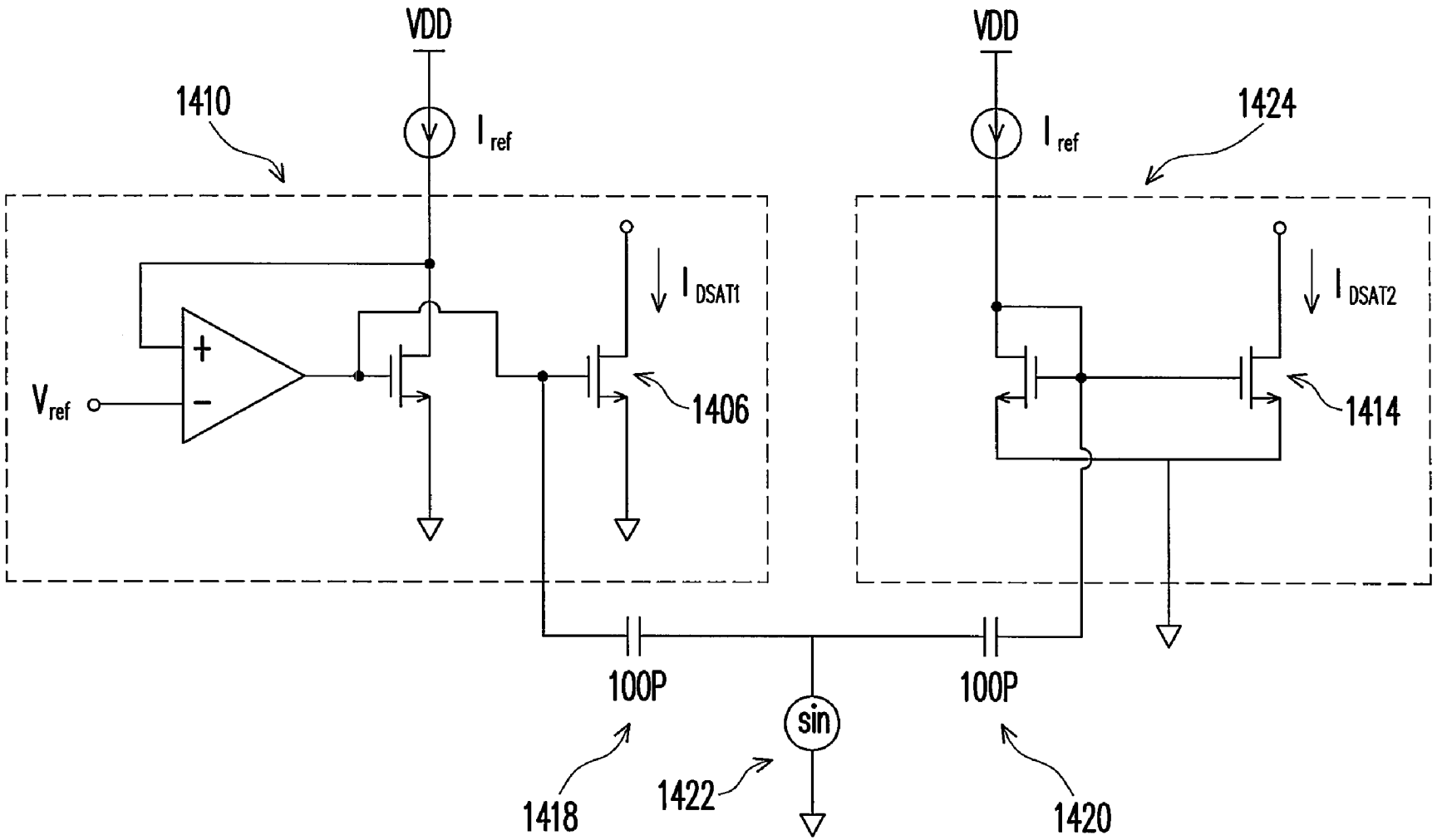
FIG. 14 is a testing circuit diagram illustrating a noise being input at the same time into a current source apparatus according to an embodiment of the present invention and a typical current source.
Figure 15:
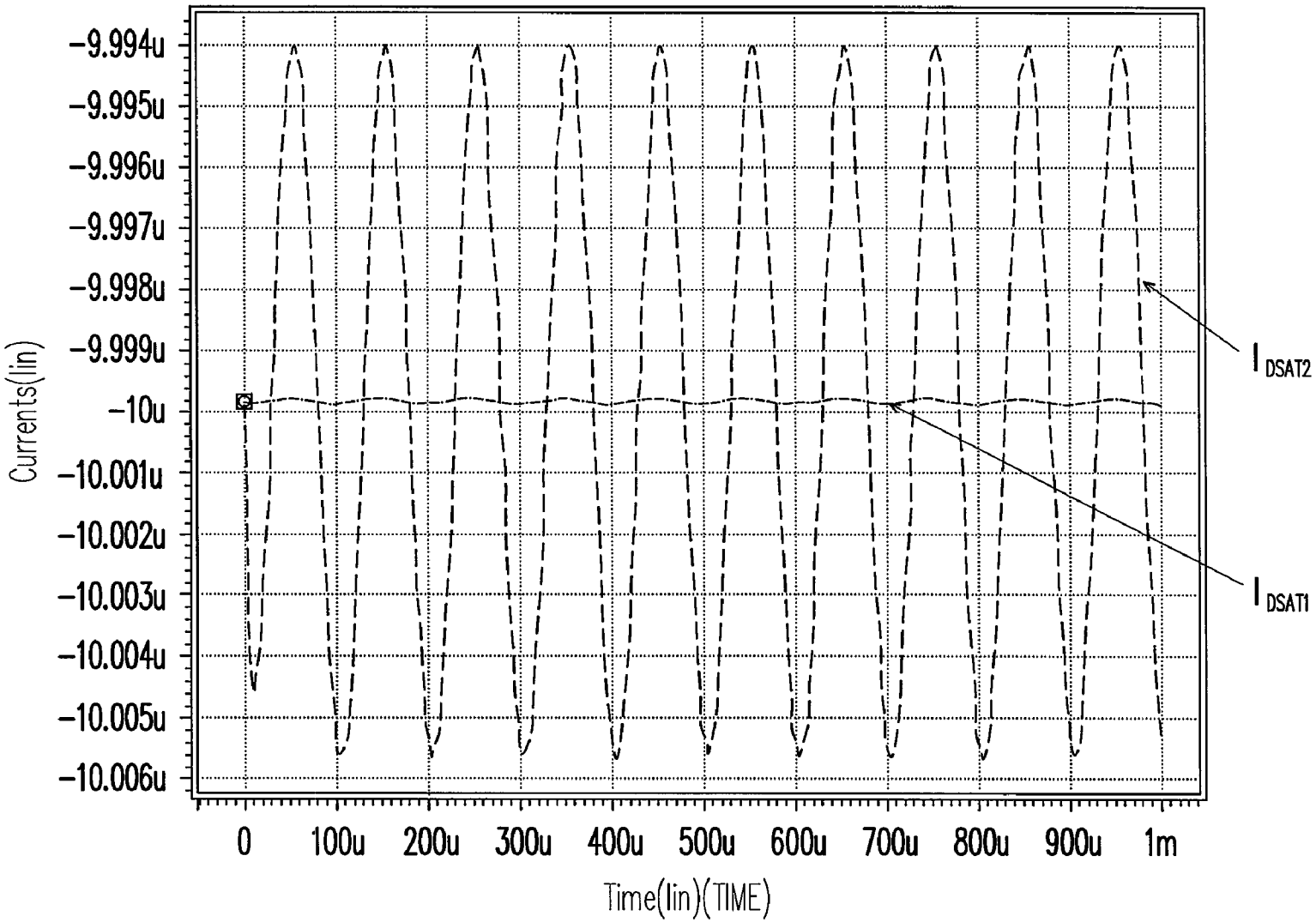
FIG. 15 is a timing diagram of $I_{DSAT1}$ and $I_{DSAT2}$ in FIG. 14 when a 10 k, 10 mV sinusoidal signal is served as the noise.
Figure 16:
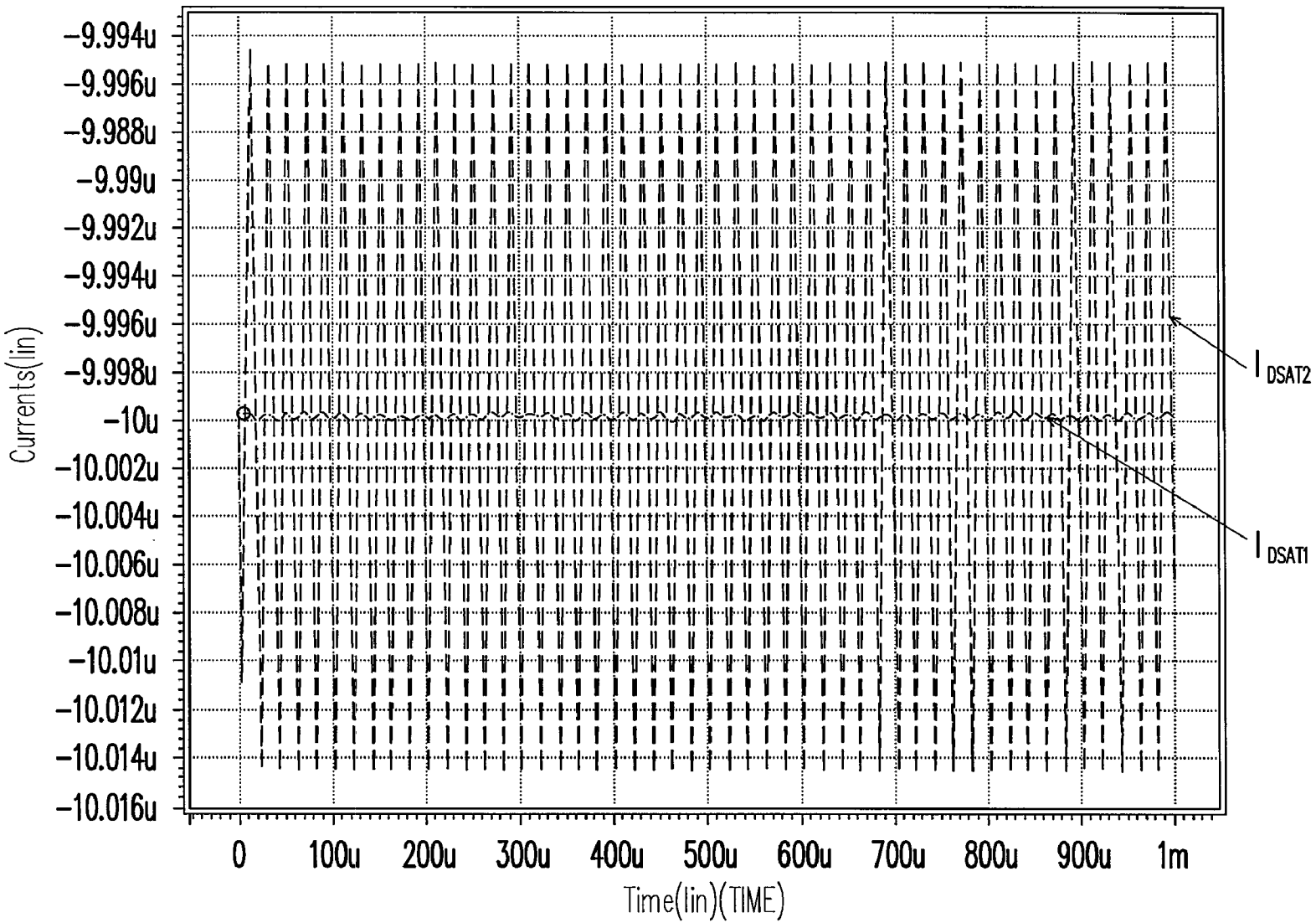
FIG. 16 is a timing diagram of $I_{DSAT1}$ and $I_{DSAT2}$ in FIG. 14 when a 50 k, 10 mV sinusoidal signal is served as the noise.

This conclusion can be proved simulatively by the circuit in FIG. 14. The dotted line block 1410 in FIG. 14 is the current source apparatus with negative feedback according to an embodiment of the present invention, the dotted line block 1424 is a typical current mirror current source. When a sinusoidal signal 1422 is respectively coupled to the gates of the transistors 1406 and 1414 by two capacitors 1418 and 1420 of 100 pF, here the affections of the sinusoidal signal 1422 to the output currents $I_{DSAT1}$ and $I_{DSAT2}$ of the two current sources are respectively observed. FIG. 15 is a timing diagram of $I_{DSAT1}$ and $I_{DSAT2}$ in FIG. 14 when a 10 k, 10 mV sinusoidal signal is served as the noise. FIG. 16 is a timing diagram of $I_{DSAT1}$ and $I_{DSAT2}$ in FIG. 14 when a 50 k, 10 mV sinusoidal signal is served as the noise. It can be observed from FIG. 15 and FIG. 16 that regardless whether the input noise is 10 kHz or 50 kHz, the variations of the currents produced by the current sources with negative feedback circuits are all smaller than that produced by the typical current mirror current source. This result proves that negative feedback current source can eliminate most noises produced by the current source itself or externally.

In overview, the present invention provides a current source apparatus for reducing interference with noise, and the performance of the current source apparatus for eliminating noises from supply voltage is much better than that of a typical current source circuit, thus, frequency modulation (FM) and amplitude modulation (AM) thereof to external noises are greatly reduced, and meanwhile, the power supply rejection ratio (PSRR) thereof is considerably improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A current source apparatus for reducing interference with noise, comprising:

a controllable current source, providing an output current based on a control signal, producing a feedback signal based on the output of the controllable current source; and a feedback controller, coupled to the controllable current source, receiving the feedback signal, adjusting and outputting the control signal based on the feedback signal, so as to control the controllable current source to output the stable output current, wherein the feedback controller comprises:

a first reference current source, providing a first reference current; and a first transistor, having its gate connected to the feedback signal, a first terminal of the first transistor being connected to the first reference current source, a second terminal of the first transistor being connected to a first constant voltage;

wherein the voltage at the first terminal of the first transistor is the control signal.

2. The current source apparatus as claimed in claim 1, wherein the feedback signal is a voltage signal or a current signal.

3. The current source apparatus as claimed in claim 1, wherein the feedback controller comprises:

an operational amplifier, for adjusting and outputting the control signal based on the feedback signal received by the first input terminal of the operational amplifier and a reference voltage received by the second input terminal of the operational amplifier.

4. The current source apparatus as claimed in claim 1, wherein the first constant voltage is a supply voltage or a ground voltage.

5. The current source apparatus as claimed in claim 1, wherein the controllable current source comprises:

a master current source, for receiving the control signal, adjusting and producing a master current based on the received control signal, outputting the feedback signal based on the produced master current; and a slave current source, coupled to the master current source, for correspondingly producing the output current based on the master current.

6. The current source apparatus as claimed in claim 5, wherein the master current source comprises:

a second reference current source, providing a second reference current; and a second transistor, having its gate connected to the control signal, the first terminal of the second transistor being connected to the second reference current source, the second terminal of the second transistor being connected to a second constant voltage, the second transistor adjusting the master current passing through the first terminal and the second terminal of the second transistor based on the control signal;

wherein the signal of the first terminal of the second transistor is the feedback signal.

7. The current source apparatus as claimed in claim 6, wherein the second constant voltage is a supply voltage or a ground voltage.

8. The current source apparatus as claimed in claim 6, wherein the slave current source comprises:

a third transistor, having its gate connected to the control signal for adjusting the output current passing through the first terminal and the second terminal of the third transistor based on the control signal.

9. The current source apparatus as claimed in claim 6, wherein the master current source further comprises:

a fourth transistor coupled between the second transistor and the second constant voltage, and a gate of the fourth transistor is also coupled to a second terminal of the second transistor; and the slave current source comprises:

a third transistor, having its gate connected to the control signal for adjusting the output current passing through a first terminal and a second terminal of the third transistor based on the control signal; and a fifth transistor, having its gate coupled to the gate of the fourth transistor, and the first terminal and the second terminal of the fifth transistor being respectively coupled to the third transistor and the second constant voltage.

10. The current source apparatus as claimed in claim 5, wherein the master current source comprises:

a second reference current source, for providing a second reference current;

a second transistor, having its gate connected to the control signal, the first terminal of the second transistor being connected to the second reference current source, the second transistor adjusting the master current passing through the first terminal and the second terminal of the second transistor based on the control signal; and a fourth transistor, having its gate and a first terminal coupled to the second terminal of the second transistor, a second terminal of the fourth transistor being coupled to a second constant voltage, wherein the signal of the second terminal of the second transistor is the feedback signal.

11. The current source apparatus as claimed in claim 10, wherein the slave current source comprises a third transistor, a gate of the third transistor is connected to the gate of the fourth transistor for adjusting the output current passing through a first terminal and a second terminal of the third transistor based on the gate of the third transistor.

12. The current source apparatus as claimed in claim 5, wherein the master current source comprises:

an impedance, having its first terminal connected to a third voltage;

a second transistor, having its gate connected to the control signal, the first terminal of the second transistor being connected to the second terminal of the impedance, the second terminal of the second transistor outputting the feedback signal, the second transistor adjusting the master current passing through the first terminal and the second terminal of the second transistor based on the control signal; and a fourth transistor, having its gate and first terminal coupled to the second terminal of the second transistor, the second terminal of the fourth transistor being connected to a second constant voltage; and the slave current source comprises:

a third transistor, having its gate connected to the gate of the fourth transistor, the third transistor adjusting the output current passing through the first terminal and the second terminal of the third transistor based on the gate of the third transistor.

13. The current source apparatus as claimed in claim 12, wherein the second constant voltage is a ground voltage, and the third voltage is a supply voltage.

14. The current source apparatus as claimed in claim 12, wherein the second constant voltage is a supply voltage, and the third voltage is a ground voltage.

15. The current source apparatus as claimed in claim 1, wherein the output current is used for driving an oscillator.

16. The current source apparatus as claimed in claim 15, wherein the oscillator is a current control oscillator.

* * * * *